US005930862A

United States Patent [19]

Garrett

[11] Patent Number: 5,930,862

[45] Date of Patent: Aug. 3, 1999

[54] RUG RAKE

[76] Inventor: Barbara I. Garrett, 6309 W. 77th Place, Los Angeles, Calif. 90045

[21] Appl. No.: 09/005,416

[22] Filed: Jan. 9, 1998

[51] Int. Cl.[6] ..... A46B 9/02; A46B 15/00

[52] U.S. Cl. ..... 15/200; 15/142; 15/186; 15/207.2

[58] Field of Search ..... 15/142, 186, 197, 15/200, 207.2; 119/612, 615, 618, 621, 625, 664

[56] References Cited

U.S. PATENT DOCUMENTS

| | | | |
|---|---|---|---|
| 753,970 | 3/1904 | Foster | 15/186 X |
| 1,178,179 | 4/1916 | Rasmesen, Jr. | 15/197 |
| 1,571,937 | 2/1926 | Frye | 15/142 X |
| 1,689,209 | 10/1928 | Majewski | 15/142 |
| 1,818,495 | 8/1931 | Midgley | 15/186 |
| 3,538,533 | 11/1970 | Woods | 15/142 X |
| 3,838,474 | 10/1974 | Erickson | 15/142 |
| 4,504,998 | 3/1985 | Price et al. | 15/186 |

FOREIGN PATENT DOCUMENTS

| | | | |
|---|---|---|---|
| 278285 | 10/1927 | United Kingdom | 15/186 |

*Primary Examiner*—Mark Spisich
*Attorney, Agent, or Firm*—W. Edward Johansen

[57] ABSTRACT

A rug rake is used for removing dead and unwanted hairs from a pile of a floor covering, such as either a rug or a carpet. The rug rake includes an elongated handle and a rake-head. The handle has a proximal end and a distal end. A person grips the proximal end of the handle. The rake head is coupled to the distal end of the handle. The rake head includes a rectangularly shaped steel support plate and a rectangularly shaped matrix of a plurality of tin plated wire bristles. Each tin plated wire bristle has a distal end and is bent at the distal end thereof.

2 Claims, 2 Drawing Sheets

Fig. 3.
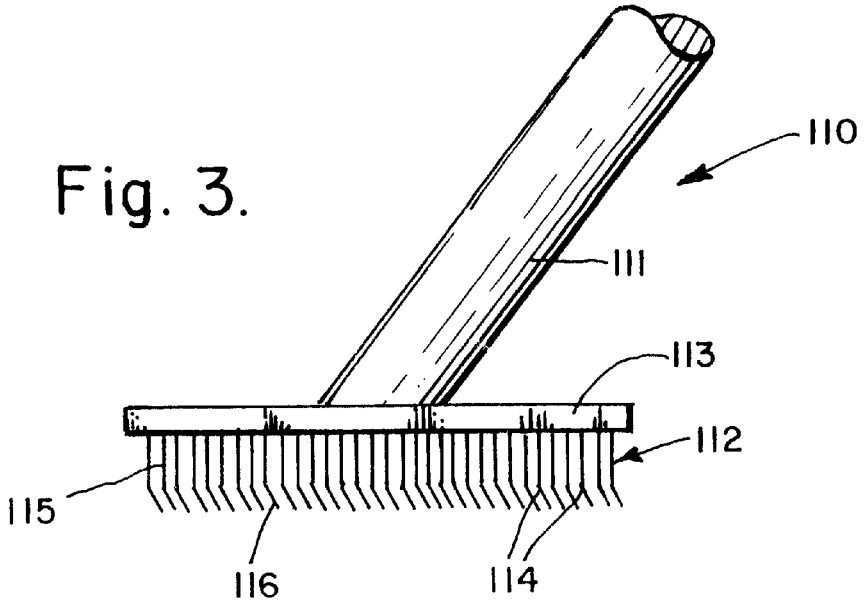
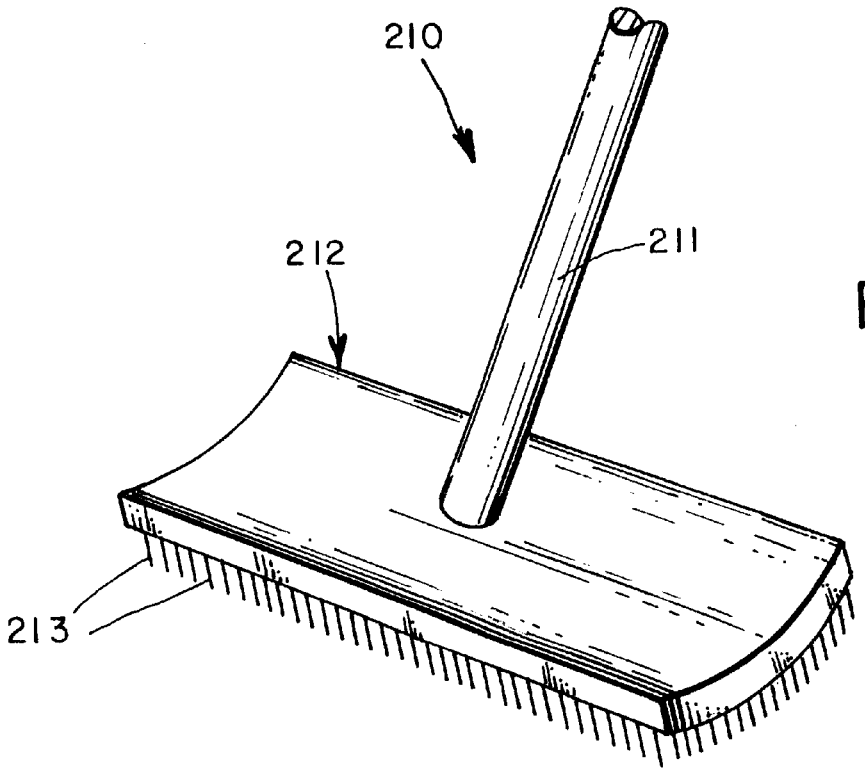
Fig. 4.

RUG RAKE

BACKGROUND OF THE INVENTION

The invention relates to a rug rake for removing dead and unwanted hairs from the pile of a floor covering, such as either a rug or a carpet.

The external growth of an animal, which take the form of fur or wool, is generally referred to as its coat. Proper grooming of the coat is essential to the health as well as the appearance of dogs and other pet animals. The hair of a dog's coat have a tendency to become entangled and matted. It is difficult to bathe a dog to remove filth, vermin and other possible causes of disease from the dog's skin unless the hairs which cover the skin are free of tangles and are unmatted. A brush for grooming a dog or other pet animal must, therefore, to be effective, be capable of dematting the coat and also of removing dead and unwanted hairs therefrom. A dog must be brushed regularly to remove dead hair and to ensure a lustrous, healthy coat.

U.S. Pat. No. 5,503,109 teaches a handle for a grooming brush which makes it possible for a groomer to grip the handle in a manner effecting optimal control for a selected mode of brushing activity, such as vigorous, down-stroke brushing. The handle has an elongated body, the front portion of which is joined to the rear of the brush at its center. The body of the handle is contoured to define in the front portion thereof a raised center thumb rest and depression on either side thereof forming left and right side thumb rests. The groomer who grips the body of the handle with his fingers may then press his thumb onto the center thumb rest to carry out one mode of brushing activity, or onto either of the side thumb rests to carry out other modes of brushing activity.

U.S. Pat. No. 5,664,587 teaches a grooming brush for cleansing and stimulating the human scalp or the skin of fur bearing animals in which contaminants are scraped from the scalp or skin during grooming with the brush. The brush is provided with a plurality of hollow bristles that collect contaminants such as sebum, dead cell tissue, shampoo, conditioner, oils and dirt from the scalps and hair follicles of humans and animals. A compressible spacer is positioned within the brush body to support a rigid plate provided with a plurality of cleaning tines employed to remove the contaminants collected by the hollow bristles. A retainer cap having an opening therein maintains the rigid metal plate, spacer, and brush body into a unitary structure. After a grooming operation, manual pressure is applied through the retaining cap opening to the rigid plate to compress the spacer and force the connected tines thereon through the individual hollow bristles to expel any collected contaminants therefrom. Upon release of the manual pressure, the compressible spacer returns to its original thickness and retracts the metal plate and tines from the hollow bristle openings to ready the brush for a subsequent grooming procedure.

U.S. Pat. No. 3,999,244 teaches a rake for raising and combing the pile of either a rug or a carpet which has a head and an elongated handle attached thereto. The head has a plurality of prongs arranged along an edge opposite the handle in at least two spaced, parallel rows with the individual prongs for each row arranged in alternating fashion. The head of the rake and the prongs are formed in a unitary, one-piece molded construction. The cantilever, double row arrangement of the prongs allows the downward force of the prongs to be essentially equal with the first row of prongs providing a raising effect on the pile with the following row combing the pile. The cross-section of the prongs is curved in a convexo-concave configuration which blends into the head to provide reinforcing and additional strength in the prongs.

U.S. Pat. No. 3,838,474 teaches a carpet rake which has a multiplicity of closely spaced parallel, fairly stiff nylon bristles in two parallel rows along the front and back of an elongated head. The nylon bristles may be molded on opposite sides of a one-piece flat rectangular nylon carrier strip that is flexed along its center line and set in a channel in the head so that one row of bristles extends from one side of the channel and the other row from the other side. All of the nylon bristles may also be separate filaments of the requisite length flexed to a generally U-shape to provide with each bristle a vertical tine in the front row and another vertical tine in the rear row. The bristles are seated in the channel and held therein tightly by a radially compressed cylindrical strip that is oversize in relation to the channel. The channel entrance has rounded edge portions which serve the double purpose of facilitating assembly and also eliminating sharp corners where the bristles are flexed relative to the head in the normal use of the tool, thereby reducing wear.

U.S. Pat. No. 5,467,590 teaches a raking tool which includes an elongated handle and a rake head mounted to a distal end of the handle. The rake head includes a support plate with a plurality of integral tines extending therefrom in mutually diverging directions between first and second edges laterally disposed relative to a longitudinal axis of the handle. The rake head is asymmetrically disposed relative to the handle, the first edge being substantially aligned with the longitudinal axis of the handle, the second edge being angularly disposed relative thereto. A first hand grip member is mounted at the proximal end of the handle and extends transversely thereof and a second hand grip member is mounted to the handle at a location spaced from the proximal end and extends in a direction angularly disposed relative to both the first hand grip member and the longitudinal axis. The support plate has a threaded mounting socket therein and the distal end of the handle is threaded for selective mounting engagement with the mounting socket.

U.S. Pat. No. 4,853,041 teaches a hand held brush specifically adapted for sweeping and cleaning regions of carpet. The brush is constructed with a handle portion in which is secured a field of bristles in a slanted bristle array. The bristle length tapers downwardly from the frontal edge of the brush to the rear edge and the flexibility varies accordingly. In this manner, the bristles may be swept through an area of carpet to remove both large and small dirt and lint particles by utilizing the varying flexibility of the bristles concomittantly with the tapering length thereacross.

U.S. Pat. No. 4,865,482 teaches a pet flea and tick brush which includes a container with deforming walls. The container includes a threaded hollow container neck in communication with the inside of the container. A hollow brush neck threadably engages the container neck. The hollow brush neck includes an essentially central axis that defines approximately between about a 50 and about a 70 degree angle with a horizontal plane. A brush head has a generally oval elliptical shaped face and is integrally bound to the brush neck.

U.S. Pat. No. 3,955,238 teaches a dog brush which is for attachment to a conventional vacuum cleaner. Semi-flexible plastic bristles are curved in the direction in which the brush is drawn across a dog, whereby to cradle loose hairs transversely of the air flow into the vacuum cleaner, and thus most efficiently to pull the loose hairs into the vacuum cleaner. Restrictive orifices are provided to increase velocity of air flow further to facilitate picking up loose hairs. The handle of the brush is oriented for most efficient brushing of a dog.

The inventor incorporates the teachings of the above-cited patents into this specification.

SUMMARY OF INVENTION

The present invention is generally directed to a rug rake which includes an elongated handle and a rake head. The handle has a proximal end and a distal end. A person grips the proximal end of the handle. The rake head is coupled to the distal end of the handle.

In a first, separate aspect of the present invention, the rake head includes a rectangularly shaped steel support plate and a rectangularly shaped matrix of a plurality of tin plated wire bristles in order to remove dead and unwanted hairs from the pile of a floor covering, such as either a rug or a carpet.

In a second, separate aspect of the present invention, each of the tin plated wire bristles is bent at its distal end.

Other aspects and many of the attendant advantages will be more readily appreciated as the same becomes better understood by reference to the following detailed description and considered in connection with the accompanying drawing in which like reference symbols designate like parts throughout the figures.

The features of the present invention which are believed to be novel are set forth with particularity in the appended claims.

DESCRIPTION OF THE DRAWINGS

FIG. 3 is a side view of a second rug rake according to the second embodiment.

FIG. 4 is a perspective drawing of a third rug rake of FIG. 1 according to the third embodiment.

DESCRIPTION OF THE PREFERRED EMBODIMENTS

Figure 1:
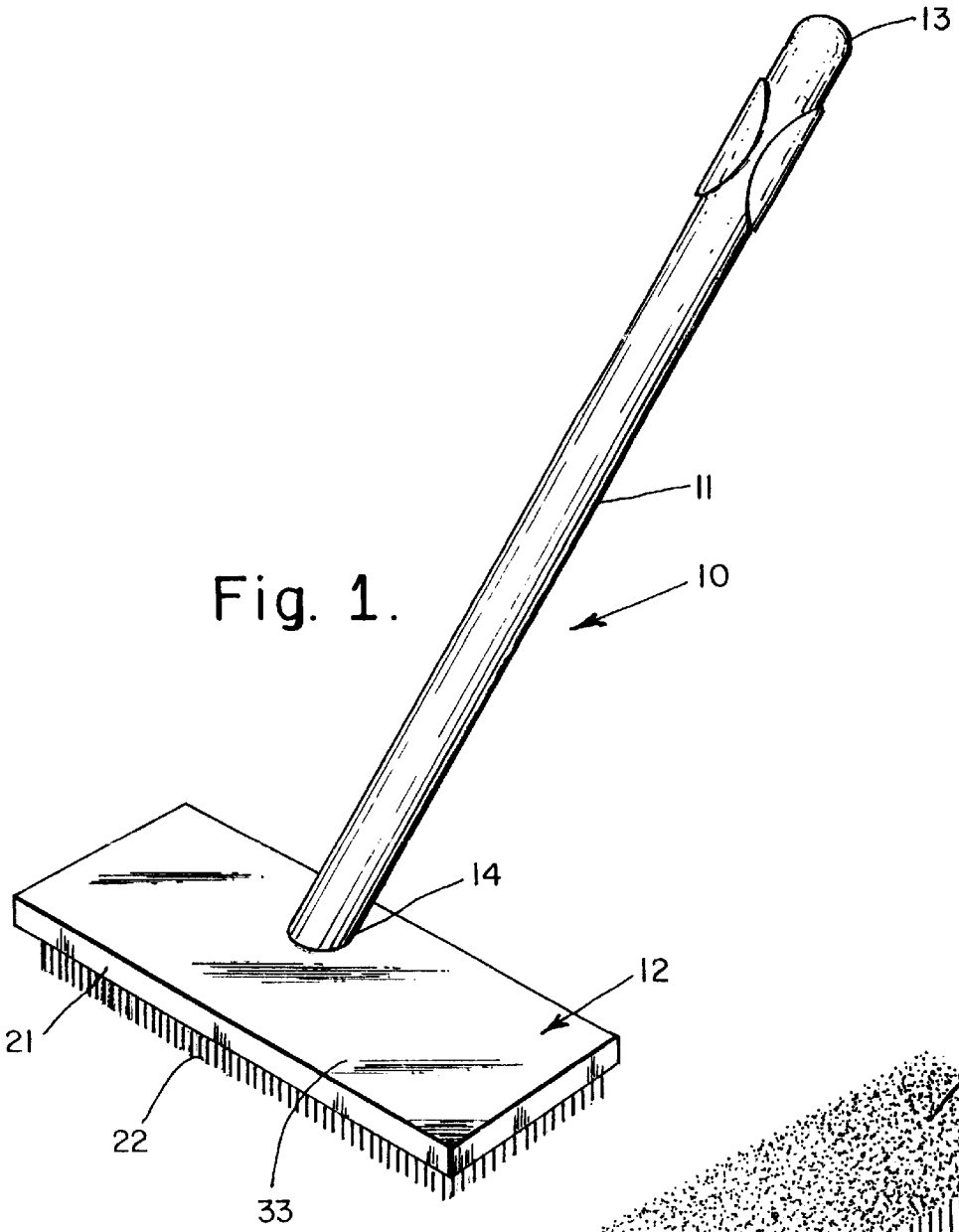
FIG. 1 is a perspective drawing of a first rug rake according to the first embodiment.

Referring to FIG. 1 a first rug rake 10 is used for raising and combing a pile of a floor covering, such as either a rug or a carpet. The first rug rake 10 includes an elongated handle 11 and a rake head 12. The handle 11 has a proximal end 13 and a distal end 14. A person grips the proximal end 13 of the handle 11. The rake head 12 is coupled to the distal end 14 of the handle 11.

Figure 2:
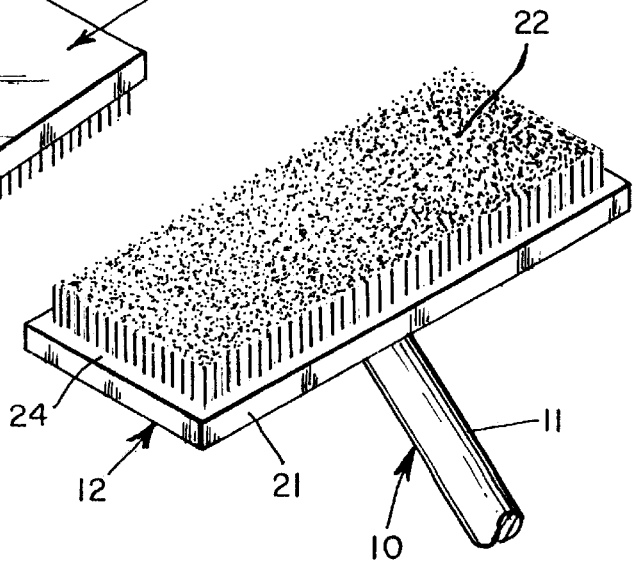
FIG. 2 is a partial, perspective drawing of the first rug rake of FIG. 1 after it has been inverted.

Referring to FIG. 1 in conjunction with FIG. 2 the rake head 12 includes a rectangularly shaped steel support plate 21 and a rectangularly shaped matrix of a plurality of tin plated wire bristles 22. The rectangularly shaped steel support plate 21 has a top surface 23 and a bottom surface 24. The first rug rake 10 is used to remove dead and unwanted hairs from the pile of a floor covering, such as either a rug or a carpet.

Referring to FIG. 3 a second rug rake 110 includes a handle 111 and a grooming brush 112. The grooming brush 112 has a rectangular base plate 113 on which an array 114 of bristles 115 is anchored. The bristles 115 are formed out of a stiff wire or synthetic plastic fibers and are bent at their distal ends. Each of the bristles 115 is bent at its distal end 116. The grooming brush 112 may have either a convex format or a planar format. The handle 111 may either be formed out of a wooden rod or be molded from a high strength, synthetic plastic material, such as either polypropylene or polycarbonate. The second rug rake 110 is used to remove dead and unwanted hairs from the pile of a floor covering, such as either a rug or a carpet.

Referring to FIG. 4 a third rug rake 210 includes a handle 211 and a concave brush 212. The concave brush 212 has wire bristles 213. The third rug rake 210 is used to remove dead and unwanted hairs from the pile of a floor covering, such as either a rug or a carpet.

From the foregoing it can be seen that a rug rake has been described. It should be noted that the sketches are not drawn to scale and that distance of and between the figures are not to be considered significant.

Accordingly it is intended that the foregoing disclosure and showing made in the drawing shall be considered only as an illustration of the principle of the present invention.

What is claimed is:

1. A rug rake comprising:

a. an elongated handle having a proximal end and a distal end whereby a person grips said proximal end of said handle;

b. a rectangularly shaped steel support plate having a top surface and a bottom surface, said top surface of said rectangular, steel support plate coupled to said distal end of said handle; and c. a rectangularly shaped matrix of a plurality of tin plated wire bristles with said bristles being disposed on said bottom surface of said rectangularly shaped steel support plate whereby said rug rake is used for removing dead and unwanted hairs from a pile of a floor covering.

2. A rug rake according to claim 1 wherein each of said tin plated wire bristles has a distal end and is bent at said distal end thereof.

* * * * *